US009032570B1

(12) United States Patent
Benami

(10) Patent No.: US 9,032,570 B1
(45) Date of Patent: May 19, 2015

(54) PILLOW WITH INTERNAL PIVOTABLE FRAME

(71) Applicant: Joseph Benami, Plano, TX (US)

(72) Inventor: Joseph Benami, Plano, TX (US)

( * ) Notice: Subject to any disclaimer, the term of this patent is extended or adjusted under 35 U.S.C. 154(b) by 0 days.

(21) Appl. No.: 14/510,061

(22) Filed: Oct. 8, 2014

(51) Int. Cl.
*A47G 9/10* (2006.01)

(52) U.S. Cl.
CPC ..... *A47G 9/1009* (2013.01); *A47G 2009/1018* (2013.01); *A47G 9/1045* (2013.01)

(58) Field of Classification Search
CPC ..... A47G 9/1009; A47G 9/1045; A47G 9/10
USPC ..... 5/636, 637, 639, 640, 643
See application file for complete search history.

(56) References Cited

U.S. PATENT DOCUMENTS

| | | | | |
|---|---|---|---|---|
| 5,974,607 | A * | 11/1999 | Smith | 5/636 |
| 6,367,105 | B1 * | 4/2002 | Farley | 5/630 |
| 6,449,788 | B1 * | 9/2002 | Nichols | 5/636 |
| 6,658,681 | B2 * | 12/2003 | Britto et al. | 5/655 |
| 7,657,954 | B1 * | 2/2010 | Bunkers | 5/644 |
| 2003/0135927 | A1 * | 7/2003 | Hsia | 5/640 |
| 2004/0039316 | A1 * | 2/2004 | Smith | 602/6 |

* cited by examiner

*Primary Examiner* — Michael Trettel
(74) *Attorney, Agent, or Firm* — John Lindsay

(57) ABSTRACT

The present invention is directed to a pillow for supporting and enclosing a portion of the head of a user, the ears in exemplary use. The pillow includes a fabric shell, which in turn encompasses padding of soft compliant material. A pivotable frame is disposed within the shell. In one embodiment, the pivotable frame includes unitary semi-rigid leg, flexible substantially along its entire length. In an alternate embodiment, the pivotable frame includes of a length of a plurality of interconnected leg and joint sections. Each of the joints is connected with two legs and defines a pivot about which the legs rotate, whereby the user can manipulate the pillow from an open state to an enclosed state around a portion of his or her head.

15 Claims, 6 Drawing Sheets

PILLOW WITH INTERNAL PIVOTABLE FRAME

BACKGROUND

1. Field of the Invention

The present invention relates to pillows, more specifically to pillows with an internal pivotable frame.

2. Description of the Related Art

Lack of relaxation and sleep can be detrimental to an individual's health. Sleep deprivation can lead to decreased performance and alertness, memory and cognitive impairment, stress, automobile injury, or occupational injury. Sleep deprivation research is vast and ongoing but common causes include sleep disorders and environmental factors such as noise and light. Achieving deep sleep with a snoring partner or at noisy environment such as airport and hospital can be difficult. Individuals may have trouble finding a private place in order to block out surrounding sound and light, and may struggle to find sleep comfort while seated in a near upright position.

To alleviate sleeping problems while traveling, some consumers may use ear plugs or eye masks to block out disruptive sounds or lights, as well as portable, supportive neck pillows for upper-body comfort. Some neck pillows are preformed C-shaped cushions that wrap around the sides and back of a user's neck, to the extent that preforming allows the conformity to the neck, allowing the user to support their head in an upright fashion while seated upright. This may prevent neck cricks and pains due to slouching of the user's head while sleeping in an upright position. However, neck pillows do not offer adequate support or cushioning for the back portions of user's head, resulting in discomfort and the head resting backwards onto the neck pillow alone with no support from the seat. Compounding the issues related to current neck pillows and traveling environments is the presence of ambient noise and light. These environments can prevent some individuals from achieving deep sleep. Thus a need exists for a pillow which facilitates deep sleep while suboptimal environmental conditions.

SUMMARY

The present invention is directed to a pillow for supporting and enclosing a portion of the head of a user. The pillow comprises a shell composed of fabric, which encompasses padding of soft compliant material. A pivotable frame is disposed within the shell and in one embodiment includes a unitary semi-rigid leg, flexible substantially along its length. In an alternate embodiment, the pivotable frame is comprised of a length of a plurality of interconnected leg and joint sections. Each of the joints is connected with two legs and defines a pivot about which the legs rotate, whereby the user can manipulate the pillow from an open state to an enclosed state around a portion of his or her head.

The present invention is directed to a pillow for supporting and enclosing a portion of the head of a user, the ears in exemplary use. The pillow includes a fabric shell, which in turn encompasses padding of soft compliant material. A pivotable frame is disposed within the shell. In one embodiment, the pivotable frame includes unitary semi-rigid leg, flexible substantially along its length. In an alternate embodiment, the pivotable frame includes of a length of a plurality of interconnected leg and joint sections. Each of the joints is connected with two legs and defines a pivot about which the legs rotate, whereby the user can manipulate the pillow from an open state to an enclosed state around a portion of his or her head.

These and other features, aspects, and advantages of the invention will become better understood with reference to the following description, and accompanying drawings.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
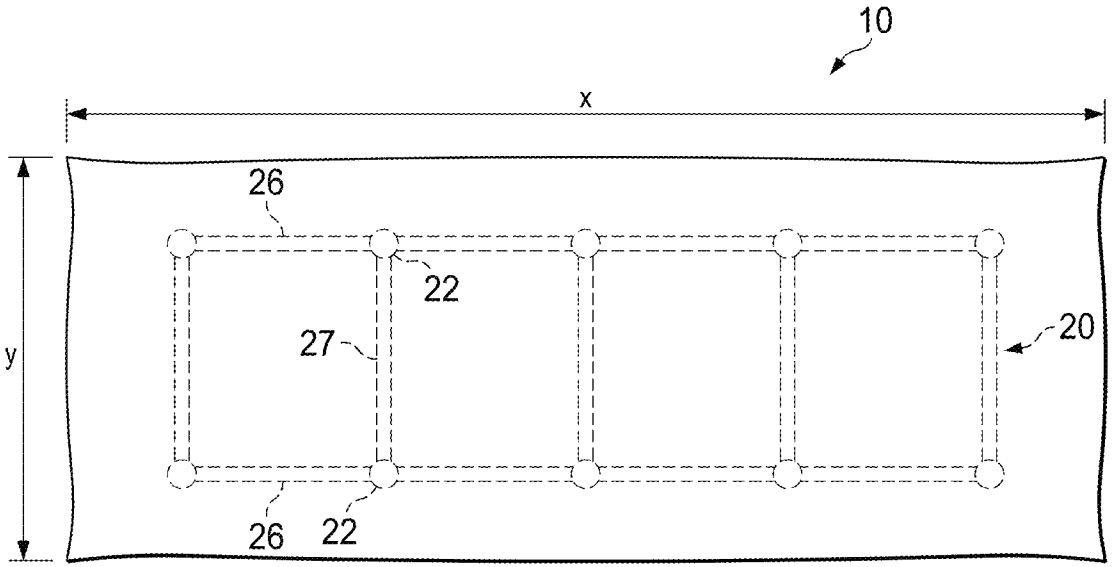
FIG. 1 depicts a front view of an embodiment of the current invention in an open state.
Figure 2A:
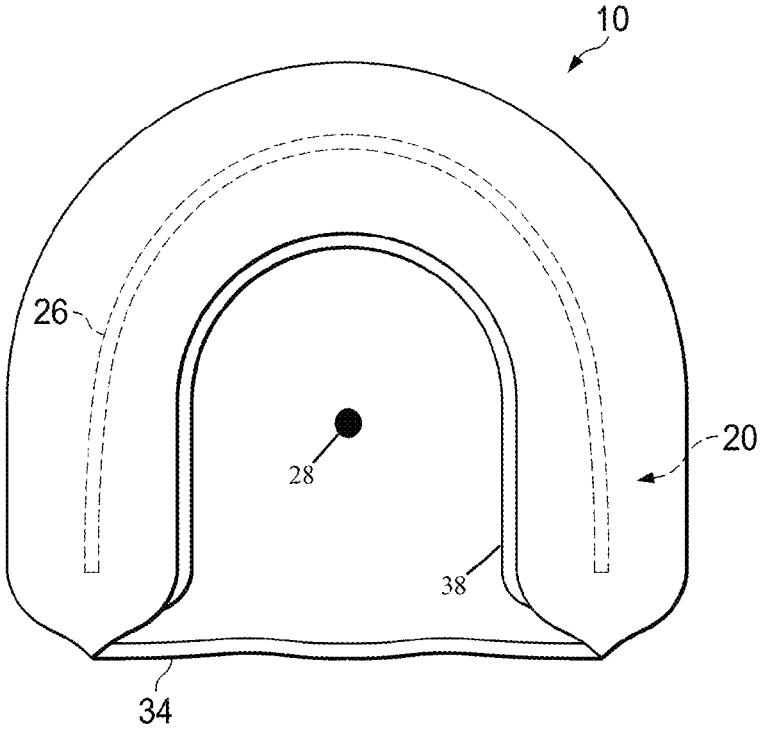
FIGS. 2*a* and 2*b* depict top views of embodiments of the current invention in a curved enclosed state.
Figure 2B:
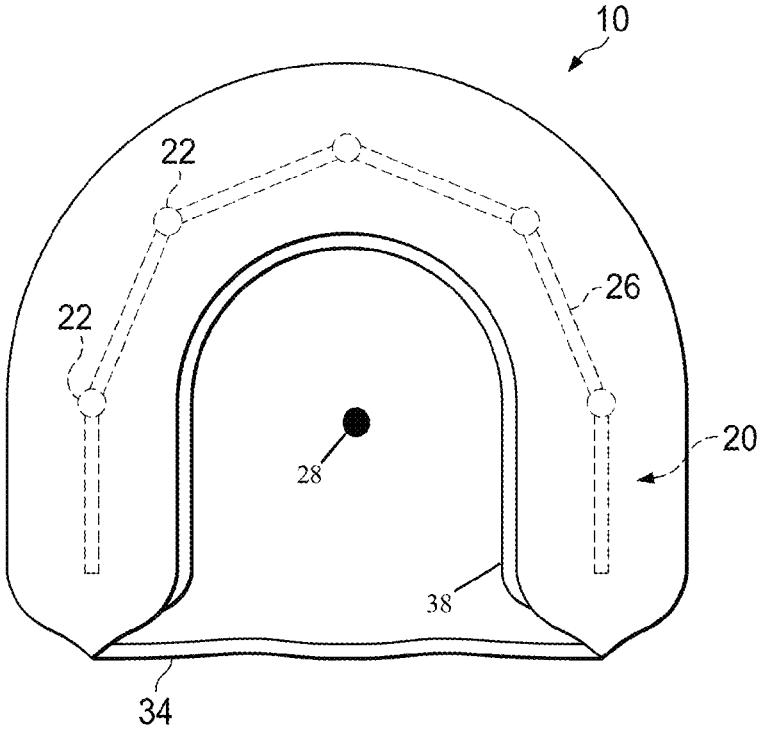

The present invention is directed to a pillow 10 with an internal pivotable frame 20 whereby its user can selectively manipulate the pillow to cover a partial perimeter around its head 08. In exemplary use, the pillow 10 is manipulated from a generally open or state to a generally concave, enclosed state with the curvature conforming to a partial perimeter of the head 08 and covering the ears 04 prior to sleep in a bed or seat. FIG. 1 illustrates an embodiment of a pillow 10 with an internal pivotable frame 20 in an open relatively planar state. Illustrated are the accoutrements of a pillow and an internal pivotal frame 20.

Figure 4A:
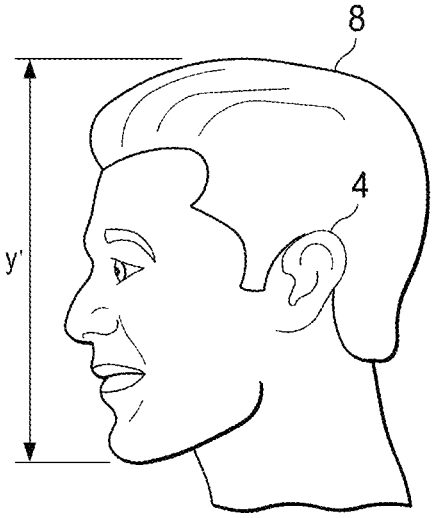
FIG. 4*a* depicts a side view of a human head.
Figure 4B:
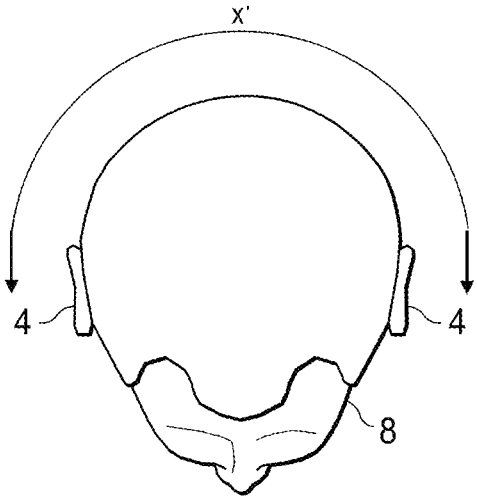
FIG. 4*b* depicts a top view of a human head.

In exemplary configuration, the pillow 10 is engaged to a user's head 08 and covers the ears 04 of the user in its enclosed state. Referring to FIGS. 4*a* and 4*b*, a representative user head 08 is shown. The head 08 has an approximate height of y' from about the top of the head 08 to the neck. The head 08 presents a partial perimeter circumference of x' spanning from about the first ear 04 to the back of the head 08 to the second ear 04. It should be understood that the height y' and ear 04 to ear 04 partial perimeter can vary.

Figure 3A:
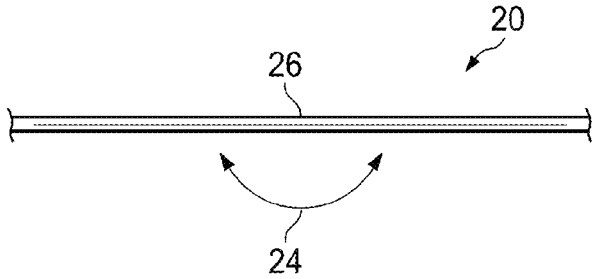
FIGS. 3*a* and 3*c* depict top views of an internal frame of embodiments of the current invention in an open state.
Figure 3B:
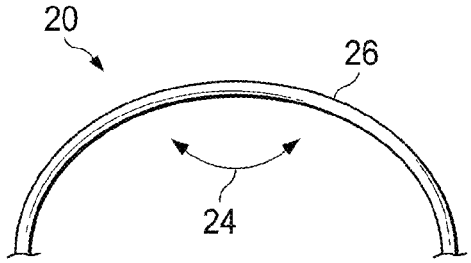
FIGS. 3*b* and 3*d* depict corresponding top views of the internal frames of FIGS. 3*a* and 3*c* in an enclosed state.
Figure 3C:
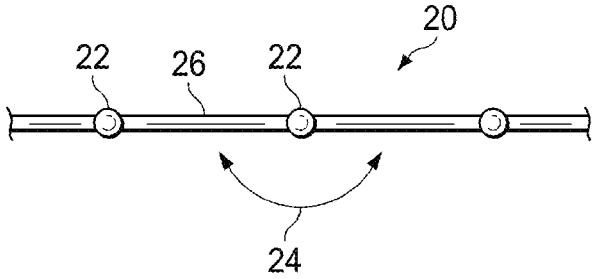
Figure 3D:
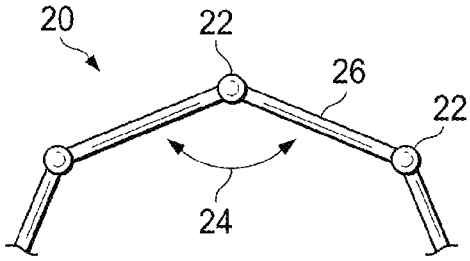

The interior of the pillow 10 includes a pivotable frame 20. FIGS. 3*a* and 3*c* show top views of pivotable frames 20 in an open state, while FIGS. 3*b* and 3*d* show top views of the corresponding pivotable frames 20 in their enclosed state, where it is curved about a point 28 to form a partial enclosure.

In one configuration, the pivotable frame 20 includes a unitary semi-rigid leg 26. The leg 26 is flexible substantially along its entire length. In exemplary configuration, the length x of the pivotable frame 20 is about the same as the target partial perimeter x', with the length of the pillow 10 following the contour of the head 08 and the ends of the pivotable frame 20 causing pillow 10 contact with each of the ears 04. The leg 26 is composed of semi-rigid, selectively, flexible material such as metals, plastics, composites, or other suitable material.

In an alternate embodiment, the pivotable frame 20 includes a plurality of interconnected leg 26 and joint 22 sections. In exemplary configuration, the length x of the pivotable frame 20 is about the same as the target partial perimeter x', with the length of the pillow 10 following the contour of the head 08 and the ends of the pivotable frame 20 causing pillow 10 contact with each of the ears 04. It is within the scope of this invention to vary the length of one or more legs 26 such that its length is at or less than a configured proportion of the total length of the interconnected leg 26 and joint 22 sections. For example, a leg 26 and joint 22 section length may be configured at less than 10% of the total length of the interconnected leg 26 and joint 22 sections, altering the degree of conformity to the head 08.

In one configuration, the pivotable frame 20 includes a single unitary leg 26 or single length of interconnected leg 26 and joint 22 sections. As shown in FIG. 1, it within the scope of this invention to include a plurality of lengths of interconnected leg 26 and joint 22 sections vertically spaced apart. In that depicted configuration, the lengths are connected by support legs 27 spanning the rows.

A pair of legs 26 is secured to each of the joints 22, whereby the joints 22 presents a vertex about which the legs 22 pivot, with the joint having an angular field 24. In one configuration, each of the joints 22 has an angular field 24 from about 0° to 180°. In another configuration, the joints 22 have an angular field 24 from about 90° to 180°. In another configuration, the joints 22 have an angular field 24 from about 135° to 180°. In yet another configuration, angular field 24 each of the joints 22 varies with its distance from the end of the pivotable frame 24.

Figure 5:
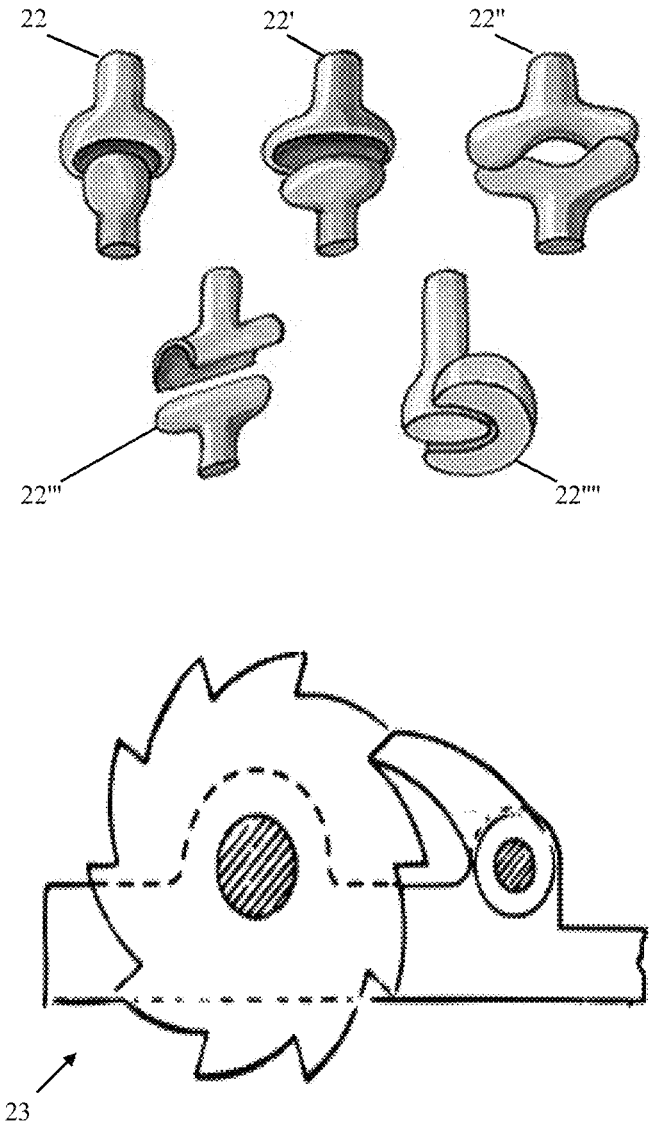
FIG. 5 depicts various joints of the current inventions.

Various types of joints 22 are within the scope of this invention. For example, the joints 22 can be locking or non-locking FIG. 5 illustrates some joint 22 types for use within the current invention. Representative, non-exclusive joint 22 types include ball and socket joints, hinges, pivot joints, saddle joints, combinations thereof, or others known in the art. The joints 22 can be combined with locking mechanisms 23 such as ratchet mechanisms or other known in the art.

The interior of the pillow 10 also includes padding 32 of soft, compliant material. Representative suitable padding 32 includes feathers, down, foam, plastic, latex, and other soft conforming materials known in the art. In one configuration, the padding 32 is human safe and hypoallergenic. In exemplary configuration, the padding 32 is formed in small dimensions such as particles or fibers.

The pillow 10 is surrounded with a shell 36. An exemplary shell is made of fabric, such as cotton, polyester, silk, blends, or others known in the art. The shell 36 may be closed on all sides and have a slit. Alternatively, the shell 36 may include a zipper for interior access.

Optionally, the pillow 10 includes a sound resistant component. Exemplary sound resistant element includes sound absorbing material, sound reflecting material, or sound reflecting structure, interspersed with the padding or layered. In one configuration, the interior of the pillow 10 includes layers of open or closed cell foam. In another configuration, the interior of the pillow 10 includes a fluid filled bladder, with the bladder being filled with fluids such as air, water, or silicone.

Optionally, the pillow 10 includes a cooling layer 38 along its front surface. The cooling layer 38 is a swatch of material, such as fabric, containing a cooling substance. In one configuration, the cooling layer 38 includes an internal pouch for a placement of a cooled substance such as cool water, ice, sodium polyacrylate solutions, or other compositions known in the art. In another configuration, the material is impregnated with an evaporative cooling substance such as polyvinyl alcohol or other compositions known in the art.

Optionally, the pillow 10 includes an eye cover 34, operable to obscure ambient light. The eye cover 34 is a swatch of material, such as fabric, having a first end and a second end. In exemplary configuration, the eye cover is 34 is attached to the first end and second end of the pillow, respectively. In such a configuration, a complete perimeter is presented, with the pillow portion covering ear 04 to ear 04 portion of the head 08 and the eye cover 34 portion covering the eyes.

Figure 6:
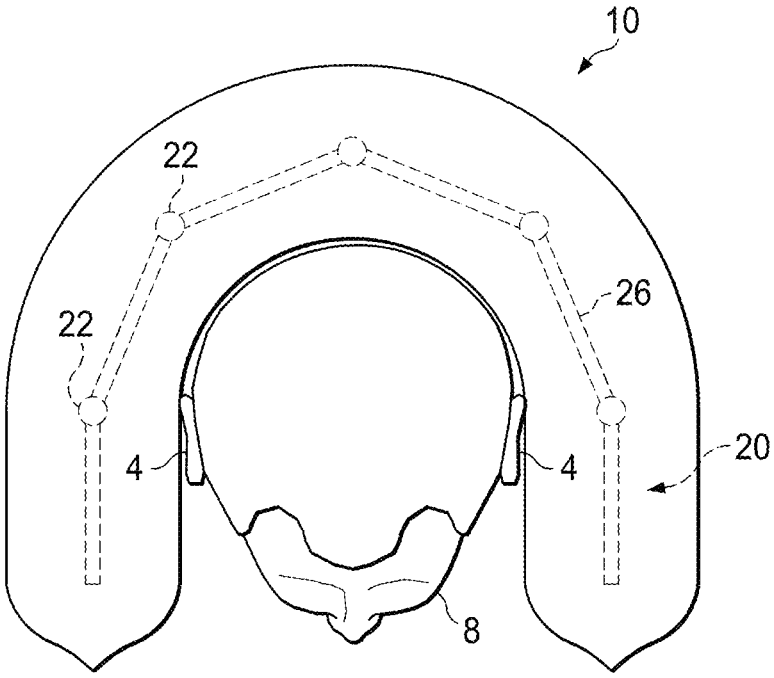
FIG. 6 depicts a top view of an embodiment of the current invention as it may exist in use.

Referring to FIGS. 1 and 6, use of the invention is shown. Initially, the pillow 10 is retrieved and is in its default open state of FIG. 1. Where applicable, the cooling layer 38 is filled with cool water or water is run over the evaporative material. The front of the pillow 10 is engaged to the back of the head 08. The pillow 10 is manipulated to the enclosed state so that the pillow 10 ends covers a portion of the head and the ears 04.

Insofar as the description above and the accompanying drawing disclose any additional subject matter that is not within the scope of the single claim below, the inventions are not dedicated to the public and the right to file one or more applications to claim such additional inventions is reserved.

The invention claimed is:

1. A pillow for enclosing a portion of the head of a user, said pillow comprising:
- a shell comprised of fabric encompassing padding;
- said padding comprised of soft compliant material;
- a pivotable frame disposed within said shell configured for user manipulation of said pillow from an open state to an enclosed state, said pivotable frame comprising a first length leg section selected from the following:
  - a length of a plurality of interconnected leg and joint sections, each of said joints connected with two legs defining a pivot about which said legs rotate; and
  - a unitary semi-rigid leg, flexible substantially along its length;
- said pivotable frame further comprises an additional length of leg sections, vertically spaced apart from and cooperatively joined with said first length leg section.

2. A pillow for enclosing a portion of the head of a user, said pillow comprising:
- a shell comprised of fabric encompassing padding;
- said padding comprised of soft compliant material;
- a pivotable frame disposed within said shell configured for user manipulation of said pillow from an open state to an enclosed state, said pivotable frame comprising a first length leg section selected from the following:
  - a length of a plurality of interconnected leg and joint sections, each of said joints connected with two legs defining a pivot about which said legs rotate; and
  - a unitary semi-rigid leg, flexible substantially along its length;
- wherein at least one of said joints is a locking joint.

3. The apparatus of claim 2, wherein said locking joint includes a ratchet.

4. A pillow for enclosing a portion of the head of a user, said pillow comprising:
- a shell comprised of fabric encompassing padding;
- said padding comprised of soft compliant material;
- a pivotable frame disposed within said shell configured for user manipulation of said pillow from an open state to an enclosed state, said pivotable frame comprising a first length leg section selected from the following:
  - a length of a plurality of interconnected leg and joint sections, each of said joints connected with two legs defining a pivot about which said legs rotate; and
  - a unitary semi-rigid leg, flexible substantially along its length;
- a sound deadening component.

5. The apparatus of claim 4, wherein said sound deadening component comprises closed cell foam.

6. The apparatus of claim 4, wherein said sound deadening component comprises open cell foam.

7. The apparatus of claim 4, wherein said sound deadening component comprises alternating layers of closed cell foam and open cell foam.

8. The apparatus of claim 4, wherein said sound deadening component comprises a fluid filled bladder.

9. The apparatus of claim 8, wherein said fluid is selected from air, water, and silicone.

10. A pillow for enclosing a portion of the head of a user, said pillow comprising:

a shell comprised of fabric encompassing padding;

said padding comprised of soft compliant material;

a pivotable frame disposed within said shell configured for user manipulation of said pillow from an open state to an enclosed state, said pivotable frame comprising a first length leg section selected from the following:

a length of a plurality of interconnected leg and joint sections, each of said joints connected with two legs defining a pivot about which said legs rotate; and a unitary semi-rigid leg, flexible substantially along its length;

a cooling layer on the external surface of said shell.

11. The apparatus of claim 10, wherein said cooling layer comprises a pouch for receipt of cooling liquid.

12. The apparatus of claim 10, wherein said cooling layer comprises an evaporative cooling material.

13. The apparatus of claim 12, wherein said evaporative cooling material comprises polyvinyl alcohol.

14. A pillow for supporting and enclosing a portion of the head of a user, said pillow comprising:

a shell comprised of fabric encompassing padding;

said padding comprised of soft compliant material;

a sound deadening component comprised of open and closed cell foam;

a pivotable frame disposed within said shell comprised of a first and an additional length of a plurality of interconnected leg and joint sections, said first and additional lengths vertically spaced apart from and cooperatively joined;

each of said joints connected with two legs defining a pivot about which said legs rotate, said joints having an angular field from about 90° to 180°, whereby said user can manipulate said pillow from an open state to an enclosed state.

15. A pillow for supporting and enclosing a portion of the head of a user, said pillow comprising:

a shell comprised of fabric encompassing padding;

said padding comprised of soft compliant material;

a sound deadening component comprised of open and closed cell foam;

a pivotable frame disposed within said shell comprised of a first and an additional unitary semi-rigid leg, flexible substantially along its length, said first and additional legs vertically spaced apart from and cooperatively joined, whereby said user can manipulate said pillow from an open state to an enclosed state.

* * * * *